US005563362A

United States Patent [19]

York

[11] Patent Number: 5,563,362

[45] Date of Patent: Oct. 8, 1996

[54] COMPENSATOR ATTACHMENT FOR A PISTOL

[76] Inventor: William H. York, 16274 Vasquez Canyon, Unit 17, Canyon Country, Calif. 91351

[21] Appl. No.: 497,792

[22] Filed: Jul. 3, 1995

[51] Int. Cl.[6] ..... F41A 21/36

[52] U.S. Cl. ..... 89/14.3

[58] Field of Search ..... 89/14.05, 14.3; D22/108

[56] References Cited

U.S. PATENT DOCUMENTS

| | | | |
|---|---|---|---|
| D. 328,632 | 8/1992 | Bigwood | D22/108 |
| 3,677,132 | 7/1972 | Plenge | 89/14.3 |
| 4,429,614 | 2/1984 | Tocco | 89/14.3 |
| 4,691,614 | 9/1987 | Leffel et al. | 89/14.3 |
| 4,942,801 | 7/1990 | Schuemann | 89/14.3 |

OTHER PUBLICATIONS

Steele, Kevin E., "What's New", Guns and Ammo, p. 34.

*Primary Examiner*—Stephen C. Bentley
*Attorney, Agent, or Firm*—Jack C. Munro

[57] ABSTRACT

A compensator attachment for a pistol which is formed of an elongated housing within which is included a box-like internal chamber that is open to the bottom surface of the housing. The barrel and slide of the pistol is to be locatable within the internal chamber with the barrel connecting with a compensating chamber mounted in the front end of the housing. A gas discharge port arrangement connects with the compensating chamber with this port arrangement to eject gas expelled from the barrel to reduce the recoil of the pistol. The back end of the housing includes a threaded fastener which is to be used to tightly secure the housing to the aft end of the slide. The housing is to be quickly removable from the slide.

10 Claims, 1 Drawing Sheet

COMPENSATOR ATTACHMENT FOR A PISTOL

BACKGROUND OF THE INVENTION

1) Field of the Invention

The field of this invention relates to pistols and more particularly to a compensator for a pistol which is to be mountable on a pistol to reduce the recoil of the pistol.

2) Description of the Prior Art

It is common knowledge that pistols, when fired, create a resulting reaction force driving the pistol upwardly. Pistols have a generally downwardly depending hand grip which, when held by a human, places the pistol barrel at an elevation above the hand of the human. When the pistol is fired, a force moment is created relative to the hand tending to twist or rotate the pistol which causes the slide and barrel of the pistol to move upwardly. This upward motion of the pistol is often referred to as the upward kick.

The upward kick of the pistol occurs so quickly that the bullet passing through the barrel is still in the process of escaping the barrel muzzle when the upward kick occurs. This upward kick affects the accuracy of the firing of the pistol. Thus, sportsmen firing pistols must try to learn to compensate for this error imparted to the path of the bullet by aiming of the pistol at an elevation below the target which was intended to be struck by the bullet. It has also been found that if the shooter modifies the grip on the pistol in order to counteract the recoil, the bullets will be thrown either to the left or to the right of the point of aim.

In the past various known devices have been devised attempting to overcome such upward kicks. It is generally conceded that if the gas that is used to propel the bullet from the barrel is discharged in a generally upward direction, that the force of that discharge will tend to counteract the recoil of the pistol. Typically by directing of the gas in an upward direction at the end of the barrel, the recoil can be diminished to be about twenty five percent or less of the amount of recoil when not using such gas directional holes. One prior art attempt was to actually machine holes in the pistol barrel with these holes directing of the gas in an upward direction. Besides this being an expensive process of pistol alteration, most pistol collectors will not under any circumstances permit any alteration of any pistol. Even so, including of such holes has been found to still permit a high amount of upward kick.

Most commonly within the prior art an adapter or attachment is utilized to the muzzle of the pistol. Again, generally there is some amount of alteration in that the attachment is generally threadably secured to the muzzle. Again, collectors of pistols do not permit any alteration of their pistols.

Also within the prior art there have been numerous other different types of attachments and even some attempting to connect to the pistol with a minimum amount of marring damage occurring to the surface of the pistol. However, invariably all prior art types of attachments will produce scratches and gouges within the surface of the pistol. Again, collectors of pistols will not under any circumstances permit the use of an attachment that detracts from the overall appearance of the pistol. The result is pistol collectors in most instances will not utilize any form of compensator.

SUMMARY OF THE INVENTION

The primary objective of the present invention is to construct a compensator which can be attached to a pistol and when removed from that pistol has not produced any kind of gouge or scratch on the surface of the pistol.

Another objective of the present invention is to construct a compensator for a pistol which can be quickly and easily attached and removed from a pistol not requiring any type of special skill.

Another objective of the present invention is to construct a compensator which can be manufactured at a reasonable cost and thereby sold to the ultimate consumer at a reasonable cost.

The compensator attachment of the present invention utilizes an elongated housing which has a top surface and a bottom surface interconnected by sidewalls, as well as a front end and a rear end. The front end is located at the barrel of the pistol and included with the front end is a compensating chamber which includes a plurality of ports which direct the bullet propelling gases in an upward direction from the compensator. The housing includes a box-like internal chamber formed within the bottom surface of the housing and it is within that box-like internal chamber that the slide and barrel of the pistol is to be located. The discharge of the gases from the plurality of ports imparts a force to the compensator and hence to the pistol in a direction opposite to the reaction forces produced in the firing of the pistol, thereby dampening these reaction forces. Mounted within the rear end of the compensator attachment is a threaded fastener which is to be secured against an insert plate which is to be placed between the aft end of the compensator attachment and the rear end of the slide of the pistol. When this fastener is tightened, the compensator attachment is securely mounted on the pistol. Appropriate openings are formed within the compensator attachment to permit ejecting of spent casings and using of the sights of the pistol.

DETAILED DESCRIPTION OF THE PREFERRED EMBODIMENT

Figure 4:
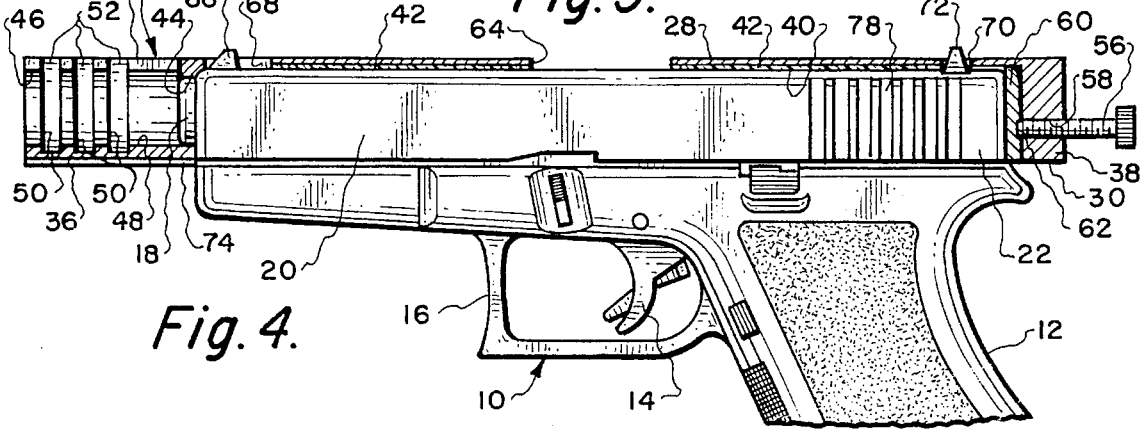
FIG. 4 is a cross-sectional view taken along line 4—4 of FIG. 3 showing the compensator attachment being mounted on a pistol.

Referring particularly to FIG. 4, there is shown a pistol 10 which has a hand grip 12, a trigger 14, a trigger guard 16, a barrel 18 and a slide 20. Slide 20 has a front end within which is mounted the barrel 18. Slide 20 has an aft end 22. The entire slide 20 is to be movable from the position shown in FIG. 4 to a rearward position (not shown) with this movement occurring during firing of the pistol 10. During this movement of the slide, the bullet (not shown) is propelled through the barrel 18 and exteriorly thereof plus ejecting of the spent casing for the bullet through an ejector 21. The movement of the slide 20 is against the bias of a spring mechanism mounted within the pistol 10. This spring mechanism is not shown. After the slide 20 has moved in a rearward direction a sufficient amount and the spent casing has been ejected, a new casing and bullet is to be inserted in conjunction with the barrel with the slide 20 then moving to the forwardmost position shown in FIG. 4.

Figure 1:
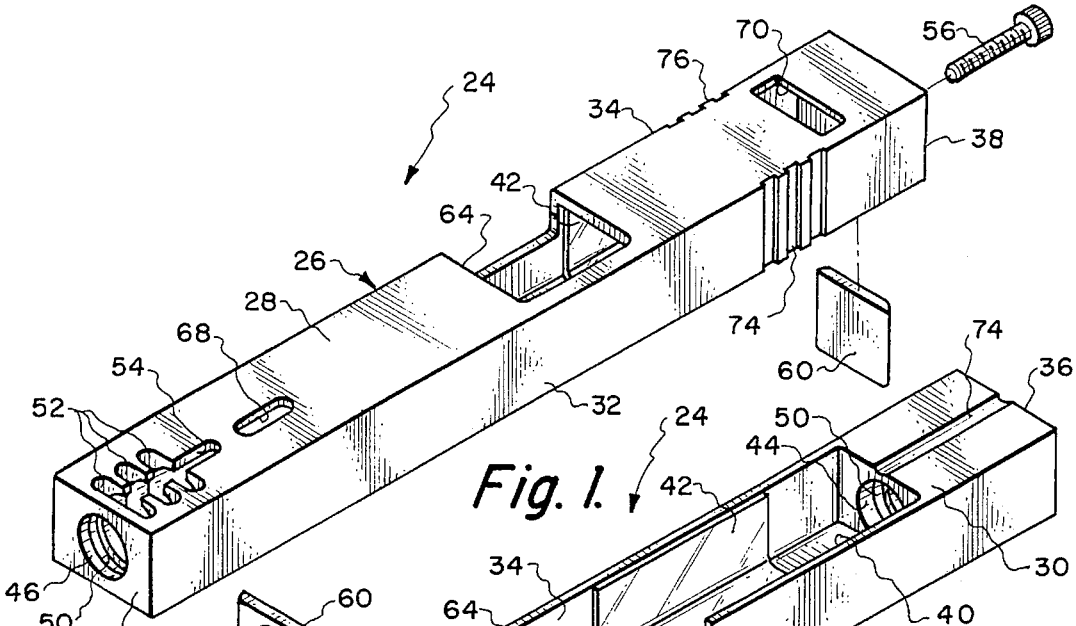
FIG. 1 is an exploded isometric view of the compensator attachment of the present invention with this isometric view being taken in the upward direction.
Figure 2:
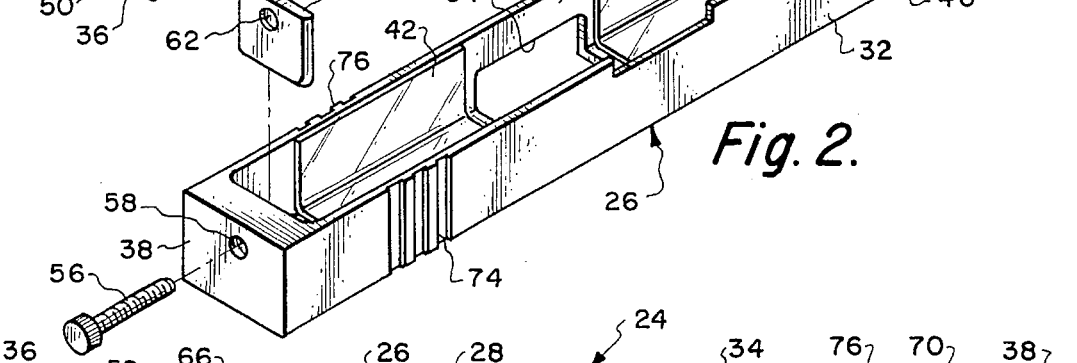
FIG. 2 is an isometric view taken generally in a bottom direction of the compensator attachment of the present invention.
Figure 3:
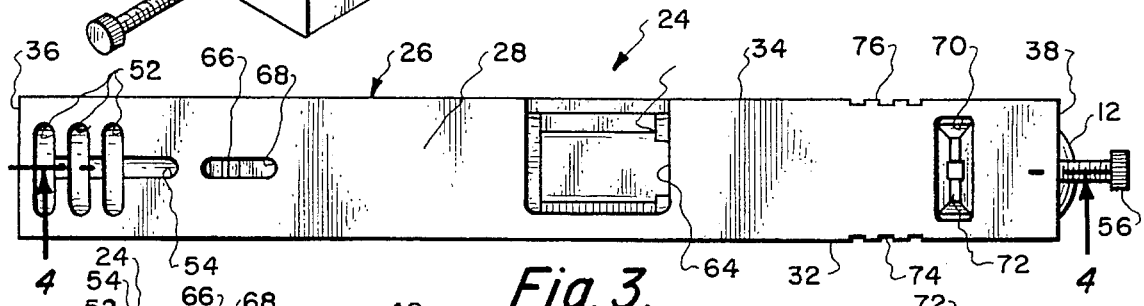
FIG. 3 is a top elevational view of the compensator attachment of the present invention.

Referring particularly to FIGS. 1 and 2 of the drawing, there is shown the compensator attachment 24 of this invention. The compensator attachment 24 is formed of an elongated housing 26 which generally will be constructed of a metallic material. However, it is to be understood that any sufficiently rigid material could be utilized. The elongated housing 26 is formed basically box-like in configuration defining a planer top wall 28 and a bottom wall 30, both which are connected together by sidewalls 32 and 34. Housing 26 also includes a front end 36 and a rear end 38.

Formed within the bottom surface 30 is an enlarged internal chamber 40. This internal chamber 40 is basically box-like in configuration and is of a length approximately three quarters of the length of the housing 26. Slide 20 and barrel 18 are to be slipped within this internal chamber 40. In order to prevent scratching of the exterior surface of the slide 20, there is included a coating 42 on appropriate areas of the wall surface of the internal chamber 40. Generally the coating 42 will be of a plastic material which will be sufficiently soft in nature as to not cause any scratches on the surface of the slide 20.

Formed within the front end 36 is a through opening composed of an inner hole 44 and an outer hole 46. The barrel 18 is to snugly rest within the inner hole 44. The outer hole 46 connects with the ambient. In between the inner hole 44 and the outer hole 46 is located a compensating chamber 48. This compensating chamber 48 includes a plurality of annular grooves 50. Three in number of the grooves are shown, but it is to be understood that this number could be increased or decreased. It is the function of the grooves 50 to provide deflecting surfaces for the gas as the gas is being ejected from the barrel 18. Connecting with each of the grooves 50 is a port arrangement formed within the top surface 28. This port arrangement comprises three in number of transverse ports 52. These transverse ports 52 connect with a longitudinal port 54.

The compensating chamber 48 works as follows: Upon the bullet (not shown) leaving the muzzle of the barrel 18, the expanding gases that have been utilized to propel the bullet then flow within the compensating chamber 48. The bullet is still blocking expulsion of the gases through the outer hole 46. As a result the gases come into contact with the grooves 50 with these gases now becoming turbulent. The only outlet for the gases 50 are then through the ports 52 and 54 with the result that these gases are propelled in an upward direction out through the ports 52 and 54 at a rather high velocity. This high velocity propelling of the gases is in a direction opposite to the reaction forces caused from the firing of the pistol 10 which causes the pistol to move in a generally upward and rearward direction. As a result, the recoil of the pistol 10 is substantially reduced.

In order to securely hold in place the compensating attachment 24 of this invention on the pistol 10, there is threadably mounted within the rear end 38 a threaded fastener 56. The threaded fastener 56 is threadably secured within internally threaded hole 58. An insert plate 60, which is generally formed of either metal or plastic, is to be located within the internal chamber 40 directly adjacent the rear end 38. The insert plate 60 is to include a recess 62 within which is to be located the tip of the threaded fastener 56. The insert plate 60 is to rest against the aft end 22 of the slide 20. It is the purpose of the insert plate 60 to prevent any scratching or gouging of the slide 20 when the threaded fastener 56 is tightened which applies a pressing force against the aft end 22 of the slide 20.

Formed within the top wall 28 and the sidewall 34 is an ejector opening 64. Ejector opening 64 is to align with the ejector 21 of the slide 20. It is to be understood that when the slide 20 moves from the forward position shown in FIG. 4 to the its rearward position and then back to the forward position that the compensator attachment 24 moves with the slide 20. When the spent casing (not shown) is ejected from the ejector 21, this spent casing will then pass through the ejector opening 64.

Mounted on the slide 20 is a forward sight 66. This forward sight 66 is to protrude through hole 68 formed within the top surface 28 of the housing 26. Also formed within the top surface 28 is a rear sight opening 70 through which the rear sight 72 is to protrude. This rear sight 72 is also mounted on the slide 20. It is to be understood that the sights 66 and 72 are to be used in a conventional manner in order to aim the pistol 10.

Formed within the bottom surface 30 is a longitudinal groove 74. The purpose of this groove 74 is to prevent interference with appropriate mechanism of the pistol 10 during the time that the slide 20 is moved and carries with it the compensator 24. Sidewall 32 includes a series of vertical grooves 74 with sidewall 32 also including a series of vertical grooves 76. The function of the grooves 74 and 76 are to function as hand gripping structure to facilitate manual movement of the slide 20 when such is desired. Normally this manual movement is to occur initially prior to firing of the pistol 10 in order to load a cartridge within the chamber for firing of the pistol 10. The grooves 74 and 76 are for the same purpose as the grooves 78 formed within the exterior surface of the slide 20. The grooves 78 are used in the same manner to manually move the slide 20 when the compensator 24 is not attached to the slide 20.

What is claimed is:

1. A compensator attachment for a pistol comprising:

an elongated housing having a front end and a rear end, said housing having a top surface and a bottom surface interconnected by sidewalls, said bottom surface being substantially open adapted to permit the entry of a slide and a barrel of a pistol, said front wall having a through opening which is adapted to connect with the barrel of the pistol, a compensating chamber connecting with said through opening, at least one gas discharge port formed in said top surface, said gas discharge port connecting with said compensating chamber; and a securing assembly mounted on said rear end, said securing assembly adapted to tightly engage with the aft end of the slide of the pistol, whereby said housing moves along with the slide of the pistol during the operation of the pistol.

2. The compensator attachment as defined in claim 1 wherein:

said substantially open bottom surface forming an internal chamber, portions of the wall surface of said internal chamber including protective plastic layers which are to prevent marring of the exterior surface of the pistol upon mounting of said compensator attachment on the pistol.

3. The compensator attachment as defined in claim 1 wherein:

said securing assembly comprising a threaded fastener.

4. The compensator attachment as defined in claim 3 wherein:

said securing assembly including an insert plate, said insert plate to be located between said threaded fastener and the pistol.

5. The compensator attachment as defined in claim 1 wherein:

said top surface and a said sidewall including an ejector opening, spent casings which are produced during operation of said pistol to be ejected through said ejector opening.

6. The compensator attachment as defined in claim 1 wherein:

said top surface including sight openings, each said sight opening to connect with a sight mounted on the pistol.

7. A compensator attachment for a pistol having a movable slide mounted in conjunction with a barrel, said compensator attachment comprising:

an elongated housing which includes an enlarged internal chamber that is open on only one side, said slide and said barrel of said pistol to be located within said enlarged internal chamber with said housing encompassing said slide and said barrel, said housing being movable along with said slide, said housing including a compensating chamber with ports to eject gas in a direction to reduce recoil of said pistol.

8. The compensator attachment for a pistol as defined in claim 7 wherein:

said elongated housing being removably mounted on said pistol.

9. In combination with a pistol, said pistol having a barrel to which is movably connected a slide, said barrel to directionally propel a bullet with said slide then to move rearwardly and eject the spent casing of the bullet, a compensator attachment for said pistol comprising:

an elongated housing having a front end and a rear end, said housing having a top surface and a bottom surface interconnected by sidewalls, said bottom surface being substantially open forming an enlarged internal chamber adapted to permit entry of said slide and said barrel of said pistol, said front wall having a through opening which is to connect with said barrel, a compensating chamber connecting with said through opening, at least one gas discharge port formed in said top surface, said gas discharge port connecting with said compensating chamber; and said slide having an aft end, said aft end to be located directly adjacent said rear end of said elongated housing, a securing assembly mounted on said rear end, said securing assembly to tightly engage with said aft end of said slide, whereby said housing moves along with said slide during operation of said pistol.

10. The combination as defined in claim 9 wherein:

said securing assembly includes a threaded fastener mounted on said rear end of said housing, an insert plate being locatable between said rear end and said aft end of said slide, said threaded fastener to fixedly connect with said insert plate pressing such tightly in connection with said aft end of said slide.

* * * * *